US007947643B2

(12) United States Patent
Lant

(10) Patent No.: US 7,947,643 B2
(45) Date of Patent: May 24, 2011

(54) LAUNDRY COMPOSITION COMPRISING A SUBSTITUTED POLYSACCHARIDE

(75) Inventor: Neil Joseph Lant, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 117 days.

(21) Appl. No.: 12/478,078

(22) Filed: Jun. 4, 2009

(65) Prior Publication Data

US 2009/0318325 A1 Dec. 24, 2009

(30) Foreign Application Priority Data

Jun. 20, 2008 (EP) ..... 08158720

(51) Int. Cl.
*C11D 3/22* (2006.01)
*C11D 3/37* (2006.01)
*C11D 3/386* (2006.01)

(52) U.S. Cl. ..... 510/470; 510/320; 510/392; 510/471; 510/473; 510/474; 8/137

(58) Field of Classification Search ..... 510/320, 510/392, 470, 471, 473, 474; 8/137
See application file for complete search history.

(56) References Cited

U.S. PATENT DOCUMENTS 4,000,093 A 12/1976 Nicol et al.
4,228,042 A 10/1980 Letton
4,239,660 A 12/1980 Kingry
4,260,529 A 4/1981 Letton
4,430,243 A 2/1984 Bragg
4,483,779 A 11/1984 Llenado et al.
4,483,780 A 11/1984 Llenado
4,565,647 A 1/1986 Llenado
5,188,769 A 2/1993 Connor et al.
5,332,528 A 7/1994 Pan et al.
5,576,282 A 11/1996 Miracle et al.
5,595,967 A 1/1997 Miracle et al.
5,597,936 A 1/1997 Perkins et al.
5,620,952 A 4/1997 Fu et al.
5,783,548 A 7/1998 Fredj et al.
6,004,922 A 12/1999 Watson et al.
6,020,303 A 2/2000 Cripe et al.
6,022,844 A 2/2000 Baillely et al.
6,093,856 A 7/2000 Cripe et al.
6,136,769 A 10/2000 Asano et al.
6,150,322 A 11/2000 Singleton et al.
6,153,577 A 11/2000 Cripe et al.
6,221,825 B1 4/2001 Williams, Jr. et al.
6,225,464 B1 5/2001 Hiler, II et al.
6,306,812 B1 10/2001 Perkins et al.
6,326,348 B1 12/2001 Vinson et al.

(Continued)

FOREIGN PATENT DOCUMENTS

WO WO 92/06162 4/1992

(Continued)

*Primary Examiner* — Brian P Mruk

(74) *Attorney, Agent, or Firm* — Julie A. McConihay; Leonard W. Lewis; Steven W. Miller

(57) ABSTRACT

Laundry treatment composition comprising a substituted polysaccharide having a degree of substitution, DS, of from 0.01 to 0.99 and a specific degree of blockiness, DB, such that either DS+DB is of at least 1 or DB+2DS−DS$^2$ is of at least 1.20, and a laundry adjunct ingredient.

20 Claims, 11 Drawing Sheets

U.S. PATENT DOCUMENTS

| | | | | |
|---|---|---|---|---|
| 6,482,994 | B2 | 11/2002 | Scheper et al. | |
| 7,501,389 | B2 | 3/2009 | Hage et al. | |
| 2006/0182703 | A1 * | 8/2006 | Arisz et al. | 424/70.13 |
| 2007/0060493 | A1 | 3/2007 | Nielsen | |

FOREIGN PATENT DOCUMENTS

| | | | |
|---|---|---|---|
| WO | WO 98/33503 | | 8/1998 |
| WO | WO 98/33504 | | 8/1998 |
| WO | WO 98/33505 | | 8/1998 |
| WO | WO 98/33506 | | 8/1998 |
| WO | WO 98/35502 | | 8/1998 |
| WO | WO 00/47708 | | 8/2000 |
| WO | WO 00/32601 | A3 | 10/2000 |
| WO | WO 01/42408 | | 6/2001 |
| WO | WO 2004/048418 | A3 | 6/2004 |
| WO | WO 2008/017570 | A1 | 2/2008 |

* cited by examiner

CH2OH
OH
O
CH2
O
OH
CH2OH
OH
O
CH2
O
OH
CH2OH
OH
O
CH2
O
OH

LAUNDRY COMPOSITION COMPRISING A SUBSTITUTED POLYSACCHARIDE

FIELD OF THE INVENTION

The present invention relates to laundry treatment composition comprising substituted polysaccharide having a specific degree of substitution and a specific degree of blockiness. The laundry treatment compositions of the present invention are in particular suitable for use in laundry detergent compositions or other fabric-treatment compositions.

BACKGROUND OF THE INVENTION

When articles such as clothes and other textiles are washed, cleaning performances may be affected by the redeposition of the soil onto the fabrics. The redeposition of the soil may manifest itself as a general greying of the textiles. Already in the 1930's it was discovered that a substituted polysaccharide, carboxymethylpolysaccharide (CMC), was particularly suitable as an antiredeposition agent and could be used in the washing water to alleviate this redeposition problem.

Although there are nowadays many types of commercial substituted polysaccharides, the substituted polysaccharide used in the laundry compositions have remained substantially the same for the past decades.

The Inventors have now surprisingly found that a specific class of substituted polysaccharide having a specific degree of substitution (DS) and degree of blockiness (DB) had unexpected better antiredeposition performance when compared with the substituted polysaccharides usually present in the commercial detergent composition.

SUMMARY OF THE INVENTION

In one embodiment of the present invention, the invention concerns a composition being a laundry treatment composition or component thereof, comprising:

a substituted polysaccharide having a degree of substitution, DS, of from 0.01 to 0.99 and a degree of blockiness, DB, such that either DS+DB is of at least 1.00 or $DB+2DS-DS^2$ is of at least 1.20 and a laundry adjunct ingredient.

The laundry treatment composition may be a detergent composition or a fabric care composition.

The laundry treatment composition may have a better antiredeposition effect than conventional laundry composition and/or may comprise a lower level of substituted polysaccharide while still providing a satisfying antiredeposition effect.

According to a further embodiment, the present invention concerns the use of a composition according to the invention as a laundry treatment composition.

The invention also concerns the use of a substituted polysaccharide having a degree of substitution, DS, of from 0.01 to 0.99 and a degree of blockiness, DB, such that either DS+DB is of at least 1 or $DB+2DS-DS^2$ is of at least 1.20, to increase whiteness of a washed fabric and/or to improve the tensile strength of cotton fibre.

According to a further embodiment, the invention concerns a laundry composition comprising a substituted polysaccharide having a degree of substitution, DS, of from 0.01 to 0.99 obtained by a process comprising one step to induce blockiness of the substituents.

According to a further embodiment, the invention concerns a laundry composition comprising a substituted polysaccharide having a degree of substitution, DS, of from 0.01 to 0.99 and comprising at least 5%, or 10%, or 15%, or even 20% of its substituted sugar units which are polysubstituted.

DETAILED DESCRIPTION OF THE INVENTION

Substituted Polysaccharide

Figure 1:
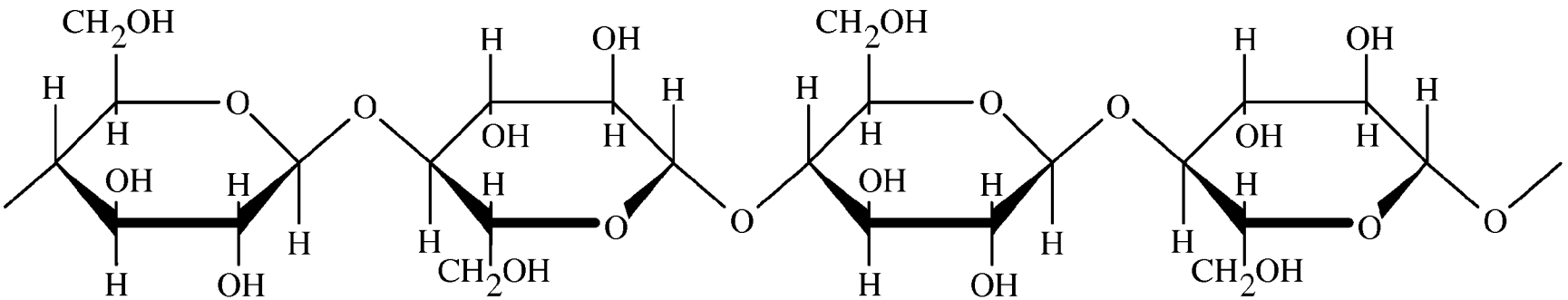
FIG. 1 illustrates a cellulose backbone.

As used herein, the term "polysaccharides" includes natural polysaccharides, synthetic polysaccharides, polysaccharide derivatives and modified polysaccharides. Natural polysaccharides can be extracted from plants, produced by microorganisms, such as bacteria, fungi, prokaryotes, eukaryotes, extracted from animal and/or humans. For example, xanthan gum can be produced by *Xanthomonas campestris*, gellan gum by *Sphingomonas paucimobilis*, xyloglucan can be extracted from tamarind seed.

The laundry treatment composition of the invention comprises a substituted polysaccharide. The substituted polysaccharide comprises a polysaccharide backbone, linear or branched, containing identical or different sugar units.

According to one embodiment of the invention, the degree of substitution, DS, of the substituted polysaccharide is of from 0.01 to 0.99. The sum of the degree of substitution and the degree of blockiness, DS+DB, of the substituted polysaccharide may be of at least 1. The $DB+2DS-DS^2$ of the substituted polysaccharide may be of at least 1.20.

The substituted polysaccharide may be substituted with identical or different substituents.

The composition of the invention may comprise at least 0.001%, or even at least 0.01% by weight of substituted polysaccharide. In particular the composition may comprise from 0.03% to 20%, especially from 0.1 to 10, or even from 0.3 to 3, for example from 1 to 1.5% by weight of substituted polysaccharide.

The substituted polysaccharide comprises unsubstituted sugar units. Unsubstituted sugar units are sugar units having all their hydroxyl groups remaining unsubstituted. In the substituted polysaccharide, the weight ratio of unsubstituted sugar units to the total number of sugar units may be comprised between 0.01 to 0.99.

The substituted polysaccharide comprises substituted sugar units. Substituted sugar units are sugar units having at least one of their hydroxyl groups being substituted. In the substituted polysaccharide, the weight ratio of substituted sugar units to the total number of sugar units may be comprised between 0.01 to 0.99.

Polysaccharide Backbone

The polysaccharide backbone consists essentially of sugar units. The polysaccharide backbone can be linear (like in cellulose), it can have an alternating repeat (like in carrageenan), it can have an interrupted repeat (like in pectin), it can be a block copolymer (like in alginate), it can be branched (like in dextran), or it can have a complex repeat (like in xanthan). Descriptions of the polysaccharides are given in "An introduction to Polysaccharide Biotechnology", by M. Tombs and S. E. Harding, T. J. Press 1998.

The polysaccharide backbone can be linear, or branched in a variety of ways such as α- or β- and 1-2, 1-3, 1-4, 1-6 or 2-3 linlages and mixtures thereof. Many naturally occurring polysaccharides have at least some degree of branching, or at any rate, at least some saccharide rings are in the form of pendant side groups on a main polysaccharide backbone.

The polysaccharide backbone may be substantially linear. By substantially linear it is to be understood that at least 97%, for example at least 99% (by weight), or all the sugar units of the polymer are in the main chain of the polysaccharide backbone.

The polysaccharide backbone preferably include, but is not limited to, one or more of the following sugar units: glucose, fructose, galactose, xylose, mannose, arabinose, rhamnose, fucose, ribose, lyxose, allose, altrose, gulose, idose, talose, glucuronic acid, and mixtures thereof.

Typically, the polysaccharide backbone is substantially constituted of sugar units selected from: glucose, fructose, galactose, xylose, mannose, arabinose, rhamnose, fucose, ribose, lyxose, allose, altrose, gulose, idose, talose, glucuronic acid, and mixtures thereof. Typically, at least one of the sugar unit, or even substantially all of them, is/are selected from glucose, xylose, galactose, arabinose, glucuronic acid, and/or mannose.

Typically, the polymeric backbone is selected from celluloses, xyloglucans, mannans, xylans, starches, and mixtures thereof.

The polymeric backbone may be substantially linear and/or may comprise beta-1,4-linked glucose units. In particular, the polymeric backbone may be a cellulose comprising beta-1,4-linked glucose units. FIG. 1 illustrates a cellulose backbone.

Figure 2:
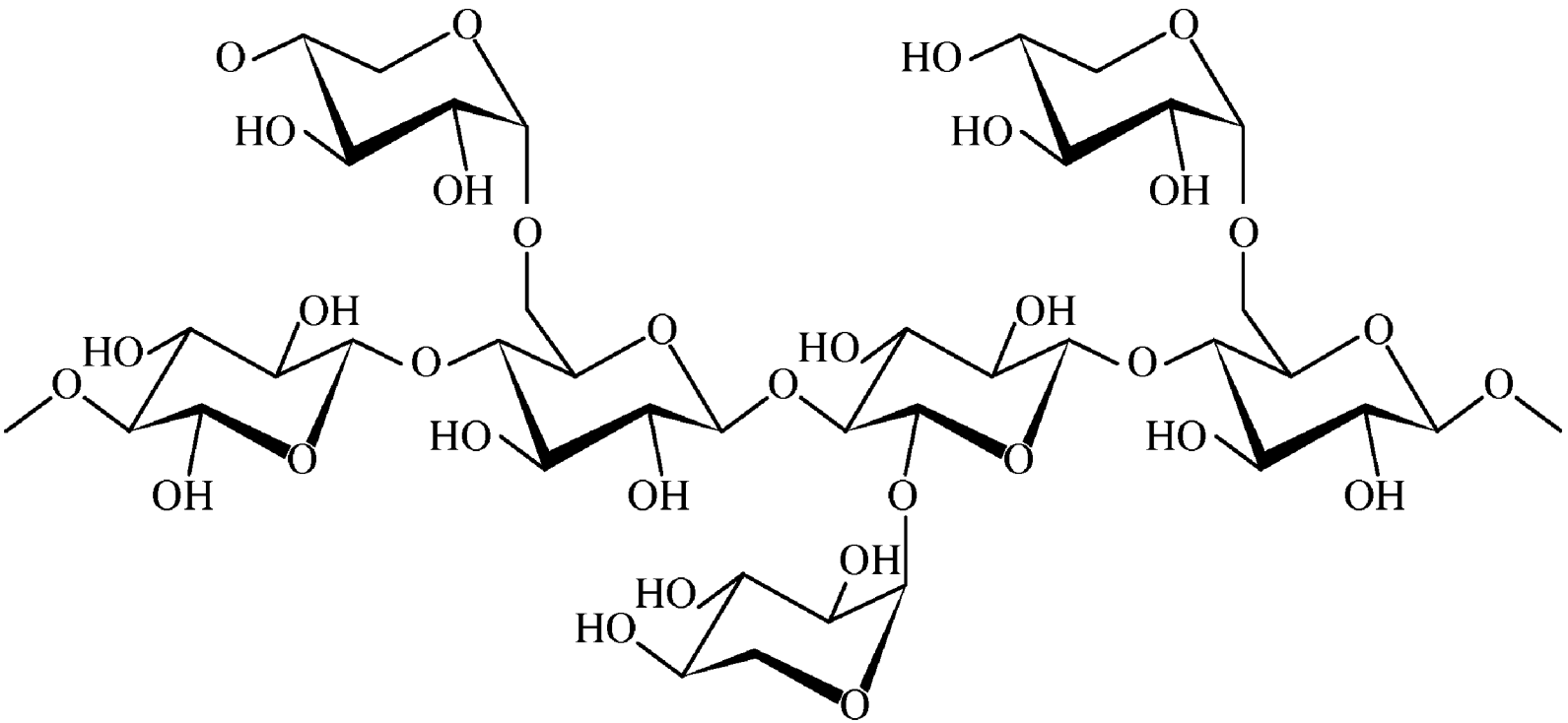
FIG. 2 is an example of a suitable xyloglucan.

The polymeric backbone may comprise a main chain comprising glucose units, such as beta-1,4-linked glucose units. The polymeric backbone may comprise lateral chain comprising one or more xylose unit(s). The polymeric backbone may be a xyloglucan. An example of a suitable xyloglucan is shown in FIG. 2.

Figure 3:
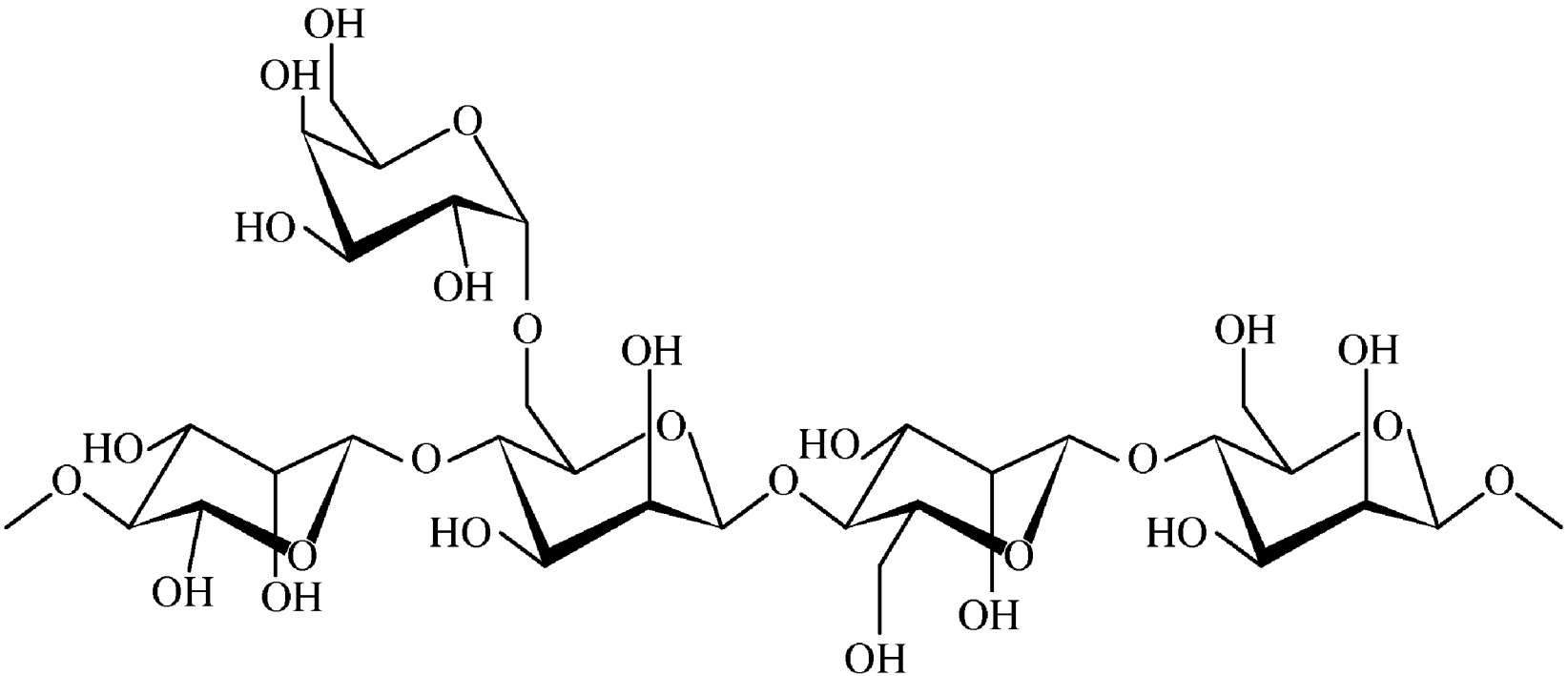
FIG. 3 is a galactomannan.
Figure 4:
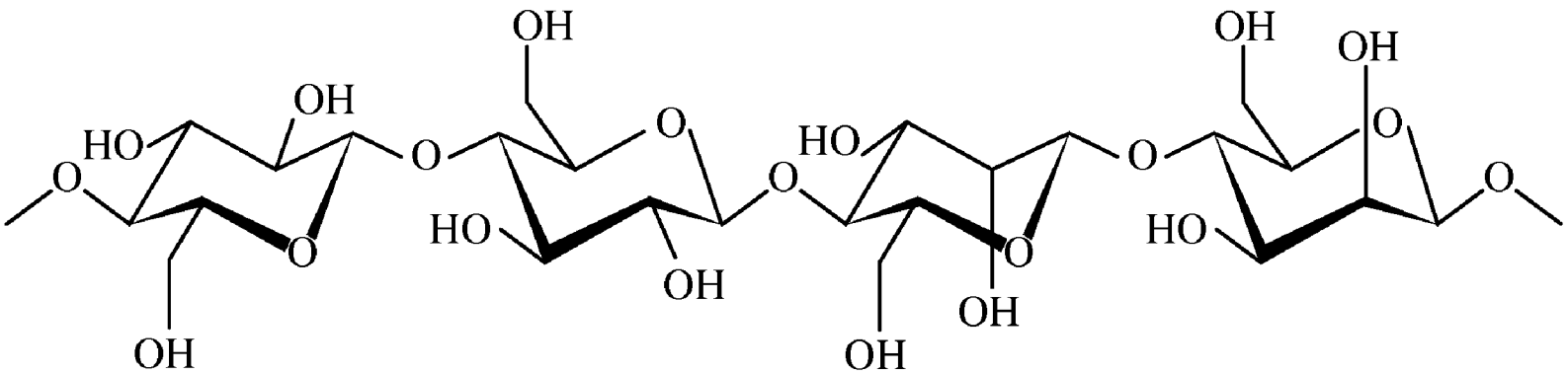
FIG. 4 is a glucomannan.

The polymeric backbone may comprise a main chain comprising manose units. The polymeric backbone may comprise a main chain or a lateral chain comprising glucose and/or galactose units. The polymeric backbone may be a mannan, for example a galactomannan or a glucomannan. A galactomannan is illustrated in FIG. 3 and a glucomannan in FIG. 4.

Figure 5A:
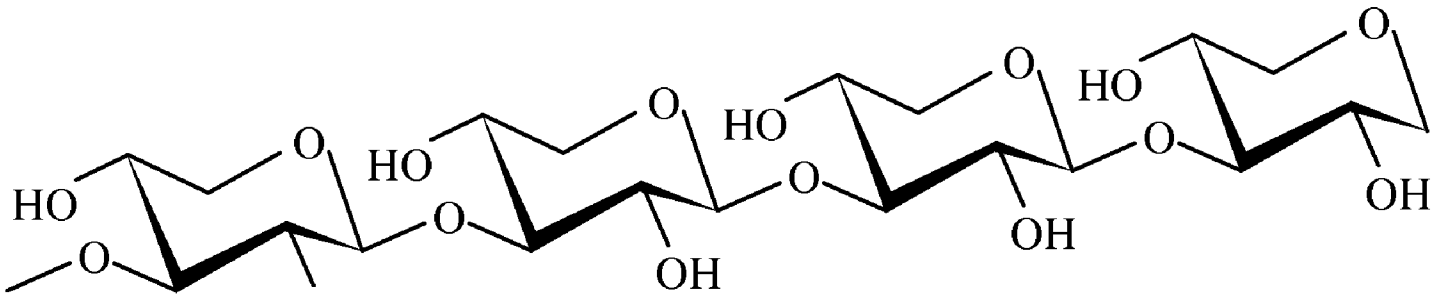
FIG. 5 is an example of a homoxylan.
Figure 5B:
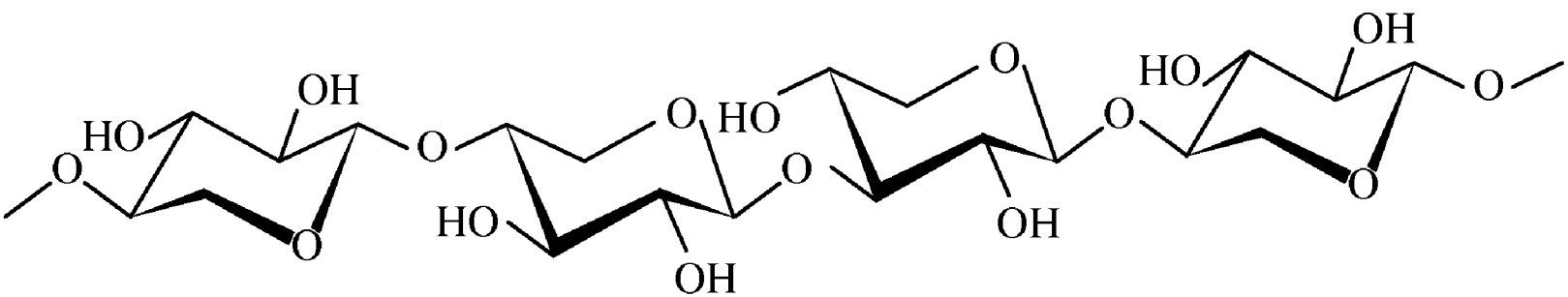
Figure 6:
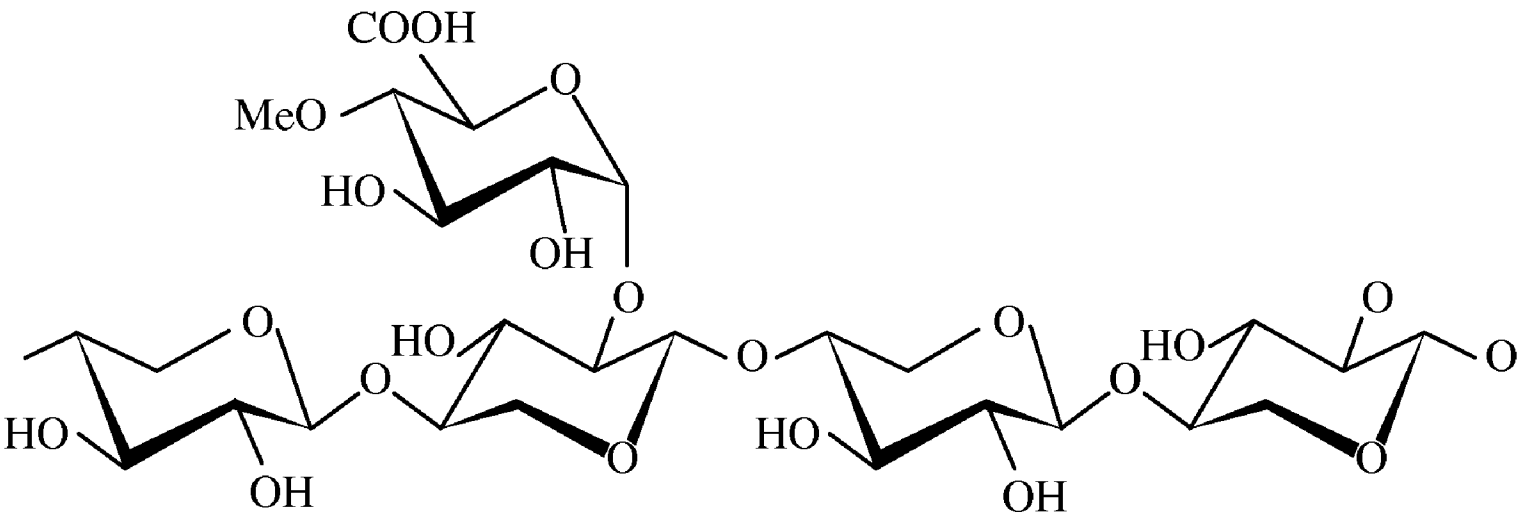
FIG. 6 is an example of a glucuronoxylan.
Figure 7:
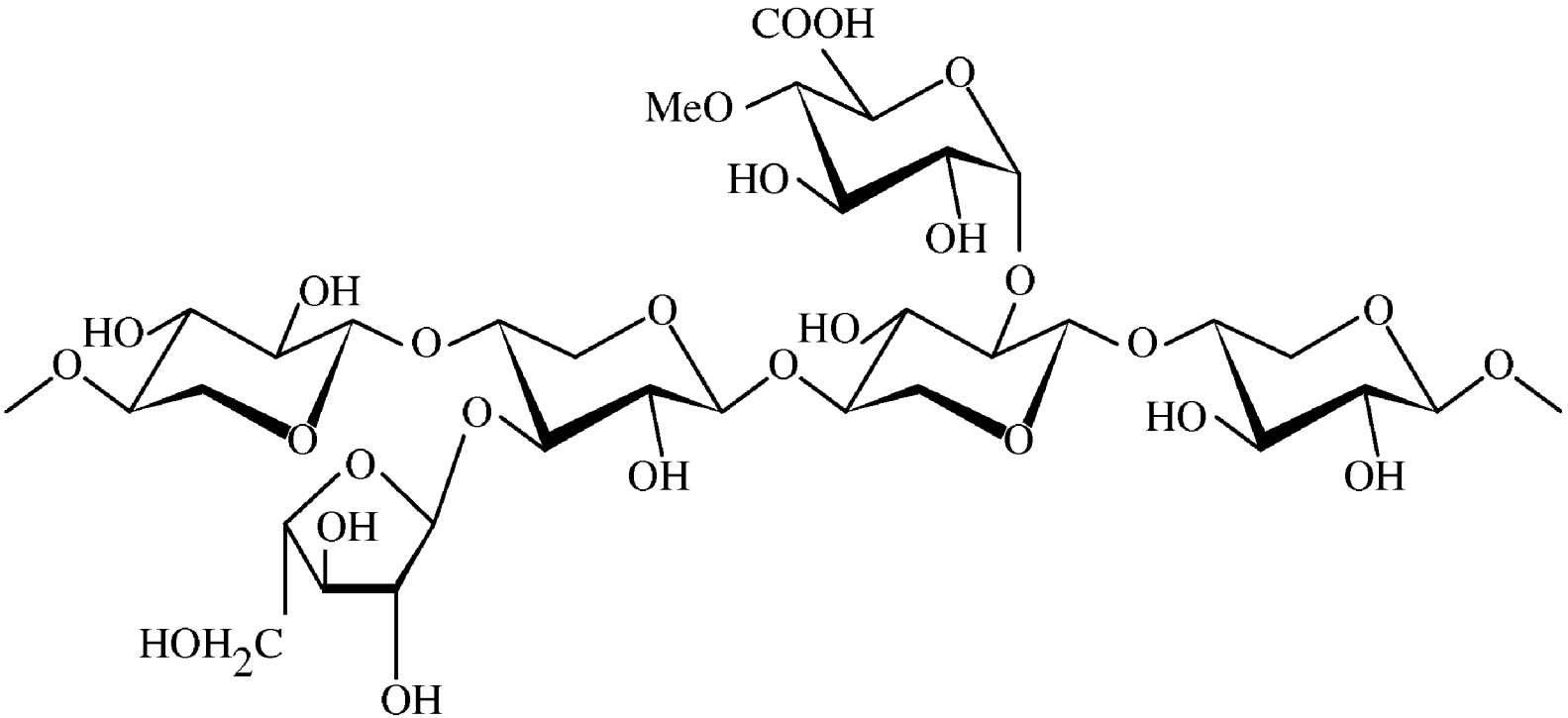
FIG. 7 is an example of a (arabino)glucuronoxylan.
Figure 8:
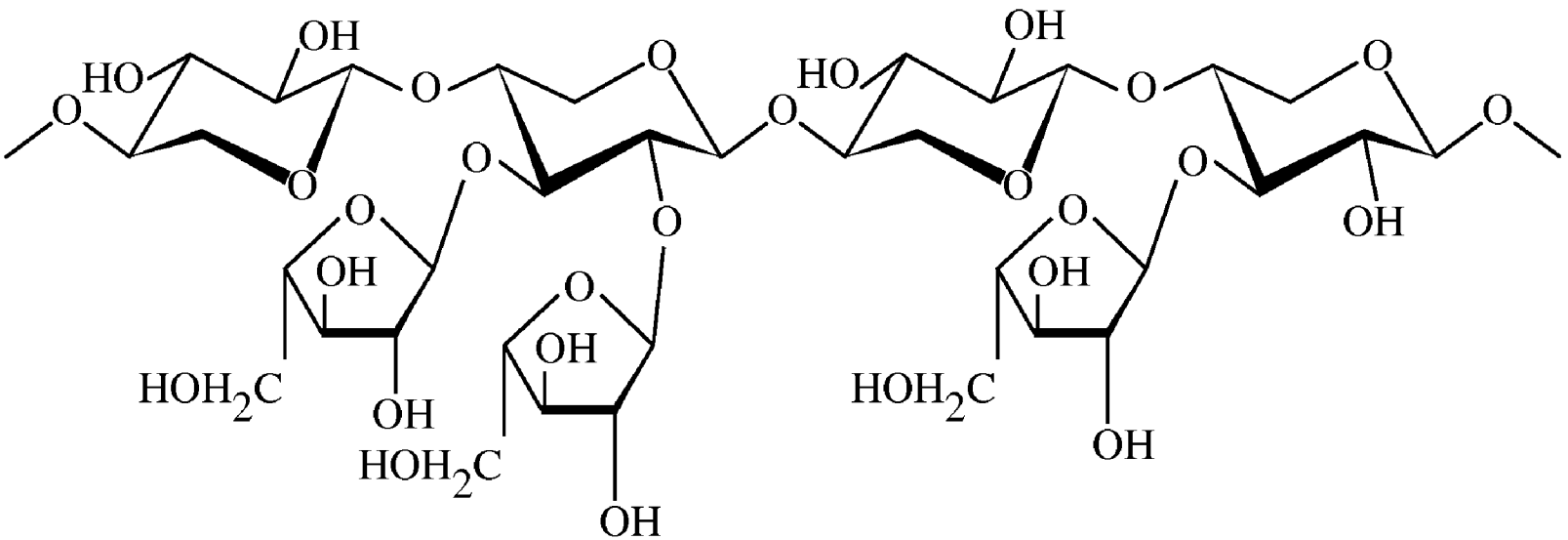
FIG. 8 is an example of a (glucurono)arabinoxylan, arabinoxylan.

The polymeric backbone may comprise a main chain comprising xylose units. The polymeric backbone may comprise a main chain or a lateral chain comprising glucuronic acid and/or arabinose. The polymeric backbone may be a xylans, for example selected from homoxylan (see for example the structures in FIG. 5), glucuronoxylan (see for example the structure in FIG. 6), (arabino)glucuronoxylan (see for example the structure in FIG. 7), (glucurono)arabinoxylan, arabinoxylan (see for example the structure in FIG. 8), and complex heteroxylans.

Figure 9:
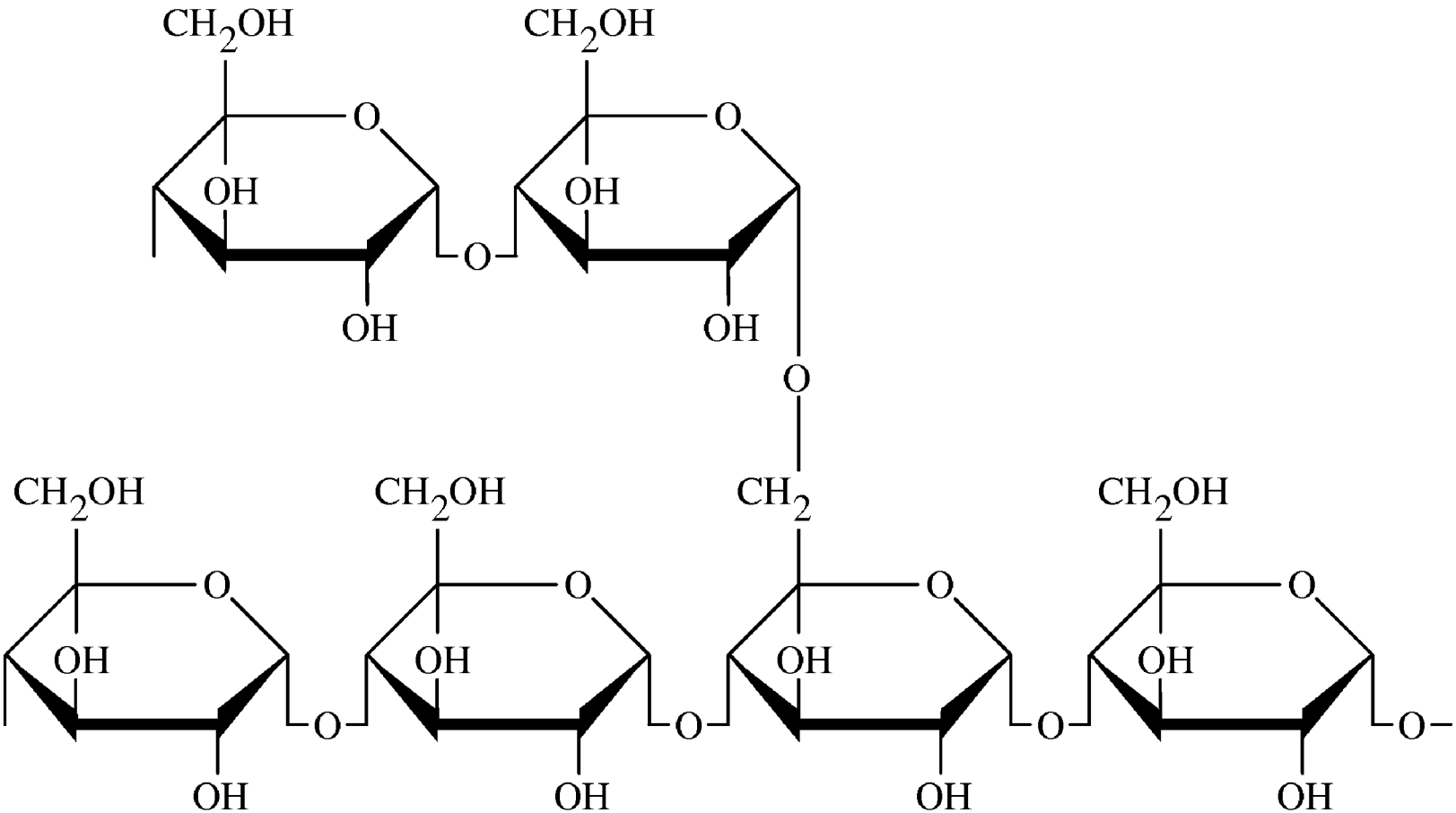
FIG. 9 is an example of an alpha-1,4-linked glucose containing alpha-1,6-branches.
Figure 10:
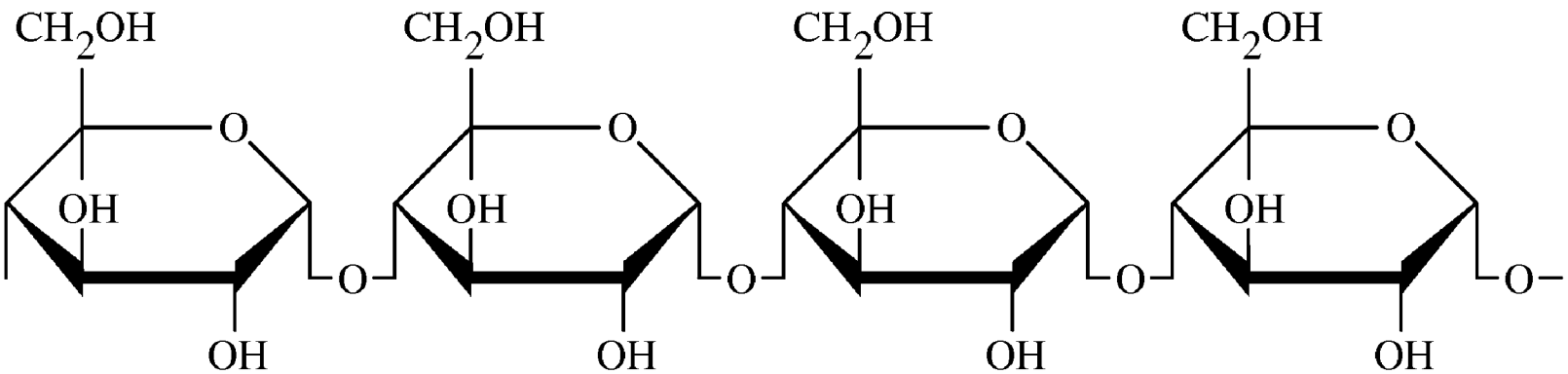
FIG. 10 is an example of an alpha-1,4-linked glucose.

The polymeric backbone may be branched and may comprise glucose units. The polymeric backbone may be a starch. Suitable starches comprise amylopectin (alpha-1,4-linked glucose containing alpha-1,6-branches, see for example the structure in FIG. 9) and optionally amylose (alpha-1,4-linked glucose, for example the structure in FIG. 10). Typical sources of starch contain mixtures of these.

Substituent

The substituted polysaccharide comprises at least one sugar unit of its backbone which is substituted. Suitable substituents may be selected from the group consisting of branched, linear or cyclic, substituted or not substituted, saturated or unsaturated alkyl, amine (primary, secondary, tertiary), ammonium salt, amide, urethane, alcohol, carboxylic acid, tosylate, sulfonate, sulfate, nitrate, phosphate, silicone, and mixtures thereof.

The substitution may take place on any hydroxyl group of the sugar unit. For example, in the case of a glucose unit linked by β-1,4 linkage to other glucose units, the substitution can take place in position 2, 3 and/or 6 of the glucose unit.

The hydroxyl group —OH of the sugar may be substituted with a —O—R or —O—C(═O)—R group.

R may be an anionic, a cationic or a non-ionic group. R may be selected from the group consisting of: $R_1$, $N(R_2)(R_3)$, silicone moiety, $SO_3^-$, $PO_3^-$, with $R_2$ and $R_3$ being independently of each other an hydrogen atom or a $C_{1-6}$ alkyl and $R_1$ being a linear or branched, typically linear, saturated or unsaturated, typically saturated, substituted or unsubstituted, typically substituted, cyclic or acyclic, typically acyclic, aliphatic or aromatic, typically aliphatic, $C_1$-$C_{300}$, typically $C_1$-$C_{30}$, $C_1$-$C_{12}$, or $C_1$-$C_6$ hydrocarbon radical which hydrocarbon backbone may be interrupted by a heteroatom chosen form O, S, N and P. $R_1$ may be substituted by one or more radical selected from amino (primary, secondary, or tertiary), amido, —OH, —CO—$OR_4$, —$SO_3^-$, $R_4$, —CN, and —CO—$R_4$, where $R_4$ represents a hydrogen atom or an alkali metal, preferably a sodium or potassium, ion.

R may be one following anionic groups, in its acid or salt form, preferably sodium (given here) or potassium salt form:

T-$CO_2$Na
T-$SO_3$Na
$PO_3$Na
$SO_3$Na

Wherein T is a $C_{1-6}$ alkyl, more preferably $C_{1-4}$ alkyl.

The R substituent may be the following cationic group:

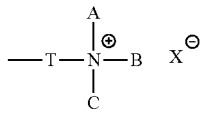

Wherein T is a $C_{1-6}$ alkyl, or $CH_2CH(OH)CH_2$, each A, B, and C is $C_{1-6}$ alkyl or hydroxy-$C_{1-6}$ alkyl, X is a counterion such as halide or tosylate.

R may be one following non-ionic groups:

A
T-OH
T-CN
C(═O)A
C(═O)$NH_2$
C(═O)NHA
C(═O)N(A)B
C(═O)OA
$(CH_2CH_2CH_2O)_nZ$
$(CH_2CH_2O)_nZ$
$(CH_2CH(CH3)O)_nZ$
$(CH_2O)_nZ$

Wherein: A and B are $C_{1-30}$ alkyl; T is $C_{1-6}$ alkyl; n=1 to 100; Z is H or $C_{1-6}$ alkyl.

R may be a hydroxyalkyl, carboxyalkyl, or sulfoalkyl group or a salt thereof. R may represent a hydroxy $C_{1-4}$ alkyl, such as a 5-hydroxymethyl group, a carboxy $C_{1-6}$ alkyl, such as a carboxy $C_{1-4}$ alkyl group, or a sulfo-$C_{2-4}$ alkyl, such as a sulfoethyl group, a $C_1$-$C_{30}$ alkanoyl or a salt (for example a sodium salt) thereof.

In exemplary embodiments, —O—R represents a group selected from —O—$CH_2OH$, —O—$CH_2CH_2SO_3H$, —O—$CH_2$—$CO_2H$, —O—CO—$CH_2CH_2CO_2H$, and salt (for example a sodium salt thereof. Preferably, the substituent is a carboxymethyl group.

The substitutent may be a benefit group, suitable benefit groups include perfumes, perfume particles, enzymes, fluorescent brighteners, oil repellent agents, water repellent agents, soil release agents, soil repellent agents, dyes including fabric renewing dyes, hueing dyes, dye intermediates, dye fixatives, lubricants, fabric softeners, photofading inhibitors, antiwrinkle/ironing agents, shape retention agents, UV absorbers, sunscreens, antioxidants, crease resistant agents, antimicrobial agents, skin benefit agents, anti-fungal agents, insect repellents, photobleaches, photoinitiators, sensates, enzyme inhibitors, bleach catalysts, odor neutralizing agents, pheromones, and mixtures thereof.

Degree of Substitution (DS).

The substituted polysaccharide of the invention has a DS of from 0.01 to 0.99.

As those of skill in the art of cellulosic polymers chemistry, recognize, the term "degree of substitution" (or DS) refers to average degree of substitution of the functional groups on the polysaccharide units of the polysaccharide backbone The maximum DS is the average number of free hydroxyl groups available per sugar monomer in the polymer. Cellulose and amylose, therefore have a maximum DS of three. Homoxylan has a maximum DS of 2. The maximum DS of more complex polysaccharides depends on the level of branching and natural substituents present on the backbone. However, the maximum DS and actual DS of a given substituent can be calculated by those skilled in the art using a variety of analytical techniques such as NMR spectroscopy or HPLC. For example, techniques for evaluating the DS of xylan derivatives are given in K. Petzold et al, Carbohydrate Polymers, 2006, v64, pp 292-298. Techniques for evaluating the DS of starch derivatives are given in M. Elomaa et al, Carbohydrate Polymers, 2004, v57, pp 261-267. Techniques for evaluating the DS of cellulose derivatives are given in V. Stiggsson et al, Cellulose, 2006, v13, pp 705-712. Techniques for evaluating the DS of xyloglucan derivatives are cited in P. Goyal et al, Carbohydrate Polymers, 2007, v69, pp 251-255.

DS values do not generally relate to the uniformity of substitution of chemical groups along the polysaccharide backbone and are not related to the molecular weight of the polysaccharide backbone. The degree of substitution of the substituted polysaccharide may be of at least 0.02, or 0.05, in particular of at least 0.10, or 0.20, or even 0.30. Typically, the degree of substitution of the polysaccharide backbone is from 0.50 to 0.95, in particular from 0.55 to 0.90, or from 0.60 to 0.85, or even from 0.70 to 0.80.

Degree of Blockiness (DB)

The substituted polysaccharide of the invention have a DB such as either DB+DS is at least of 1 or $DB+2DS-DS^2$ is of at least 1.10.

As those of skill in the art of cellulosic polymers chemistry recognise, the term "degree of blockiness" (DB) refers to the extent to which substituted (or unsubstituted) sugar units are clustered on the polysaccharide backbone. Substituted polysaccharides having a lower DB may be characterized as having a more even distribution of the unsubstituted sugar units along the polysaccharide backbone. Substituted polysaccharides having a higher DB may be characterized as having more clustering of the unsubstituted sugar units along the polysaccharide backbone.

More specifically, in a substituted polysaccharide comprising substituted and unsubstituted sugar units, the DB of the substituted polysaccharide is equal to B/(A+B), with A referring to the number of unsubstituted sugar units directly linked to at least one substituted sugar units, and B refers the number of unsubstituted sugar units not directly linked to a substituted sugar unit (i.e. only directly linked to unsubstituted sugar units).

Typically, the substituted polysaccharide has a DB of at least 0.35, or even from 0.40 to 0.90, from 0.45 to 0.80, or even from 0.50 to 0.70.

The substituted polysaccharide may have a DB+DS of at least 1. Typically the substituted polysaccharide has a DB+DS of from 1.05 to 2.00, or from 1.10 to 1.80, or from 1.15 to 1.60, or from 1.20 to 1.50, or even from 1.25 to 1.40.

The substituted polysaccharide having a DS comprised between 0.01 and 0.20 or between 0.80 to 0.99 may have a DB+DS of at least 1, typically of from 1.05 to 2.00, or from 1.10 to 1.80, or from 1.15 to 1.60, or from 1.20 to 1.50, or even from 1.25 to 1.40.

The substituted polysaccharide having a DS comprised between 0.20 and 0.80 may have a DB+DS of at least 0.85, Typically of from 0.90 to 1.80, or from 1.00 to 1.60, or from 1.10 to 1.50, or from 1.20 to 1.40.

The substituted polysaccharide may have a $DB+2DS-DS^2$ of at least 1.20. Typically the substituted polysaccharide has a $DB+2DS-DS^2$ of from 1.22 to 2.00, or from 1.24 to 1.90, or from 1.27 to 1.80, or from 1.30 to 1.70, or even from 1.35 to 1.60.

The substituted polysaccharide, having a DS comprised between 0.01 and 0.20, may have a $DB+2DS-DS^2$ of from 1.02 or 1.05 to 1.20.

The substituted polysaccharide, having a DS comprised between 0.20 and 0.40, may have a $DB+2DS-DS^2$ of from 1.05 or 1.10 to 1.40.

The substituted polysaccharide, having a DS comprised between 0.40 and 1.00 or between 0.60 and 1.00 or between 0.80 and 1.00, may have a $DB+2DS-DS^2$ of from 1.10 to 2.00, or from 1.20 to 1.90, or from 1.25 to 1.80, or from 1.20 to 1.70, or even from 1.35 to 1.60.

The methods to measure the DB may vary as a function of the substituent. The skilled person knows or may determine how to measure the degree of substitution of a given substituted polysaccharide.

The blockiness of the polysaccharide derivatives can be determined by comparing the amount of unsubstituted sugar units produced by acid treatment with the amount of unsubstituted sugar units produced by enzymatic treatment. At a given DS, the relative amount of unsubstituted sugar monomers produced by enzymatic treatment increases with increasing blockiness, as described in V. Stiggsson et al, Cellulose, 2006, v13, pp 705-712. The degree of blockiness is calculated by dividing the quantity of enzyme-liberated sugar units by the quantity of acid-liberated sugar units.

Examples of enzyme classes usable for the enzymatic digestion are listed in the table below.

| Polysaccharide backbone | Enzyme classes | E.C. Number |
|---|---|---|
| Cellulose | endo-β-1,4-glucanase | 3.2.1.4 |
| Homoxylan | endo-1,4-β-xylanase | 3.2.1.8 |

-continued

| Polysaccharide backbone | Enzyme classes | E.C. Number |
|---|---|---|
| Amylose | α-amylase | 3.2.1.1 |
| Amylopectin | α-amylase | 3.2.1.1 |
| | pullulanase | 3.2.1.41 |
| (Glucurono)arabinoxylan | glucuronoarabinoxylan endo-1,4-β-xylanase | 3.2.1.136 |
| | endo-1,4-β-xylanase | 3.2.1.8 |
| Galactomannan | mannan endo-1,4-β-mannosidase | 3.2.1.78 |
| | α-galactosidase | 3.2.1.22 |
| Glucomannan | mannan endo-1,4-β-mannosidase | 3.2.1.78 |
| Arabinoxylan | endo-1,4-β-xylanase | 3.2.1.8 |
| | α-arabinofuranosidase | 3.2.1.55 |
| | xylan 1,4-β-xylosidase | 3.2.1.37 |
| | feruloyl esterase | 3.1.1.73 |
| | endo-1,5-α-arabinanase | 3.2.1.99 |
| (Arabino)glucuronoxylan | endo-1,4-β-xylanase | 3.2.1.8 |
| | xylan 1,4-β-xylosidase | 3.2.1.37 |
| | α-arabinosidase | 3.2.1.55 |
| | α-glucuronidase | 3.2.1.139 |
| Xyloglucan | endo-β-1,4-glucanase | 3.2.1.4 |
| | xyloglucan-specific endo-β-1,4-glucanase | 3.2.1.151 |
| | α-xylosidase | 3.2.1.— |

Figure 11:
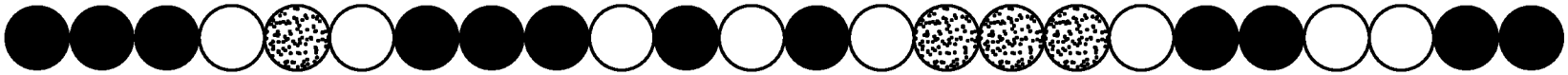
FIG. 11 represents a molecule of carboxymethyl homoxylan with each circle denoting a xylose repeating unit. Xylose units containing carboxymethyl substituents are coloured black.

As an example, FIG. 11 represents a molecule of carboxymethyl homoxylan with each circle denoting a xylose repeating unit. Xylose units containing carboxymethyl substituents are coloured black. Enzymatic digestion, which hydrolyses between non-carboxymethylated xyloses, will lead to liberation of the grey residues as free xylose. Acid digestion liberates all unsubstituted xyloses, i.e. the grey and white circles. The degree of blockiness is calculated by dividing the quantity of enzyme-liberated xylose by the quantity of acid-liberated xylose, in this case $4/12=0.33$.

Viscosity of the Substituted Polysaccharide.

The substituted polysaccharide has typically a viscosity at 25° C. when dissolved at 2% by weight in water of at least 100 mPa·s for example a viscosity of from 250 to 5000, or from 500 to 4000, from 1000 to 3000 or from 1500 to 2000 mPa·s. The viscosity of the polysaccharide may be measured according to the following test method.

Test Method 3: Evaluation of Substituted Polysaccharide Viscosity

A solution 2% by weight of the polysaccharide is prepared by dissolving the polysaccharide in water. The viscosity of the solution is determined using a Haake VT500 viscometer at a shear rate of 5 $s^{-1}$, at 25° C. Each measurement is done for 1 minute with 20 measuring points collected and averaged.

Molecular Weight of the Substituted Polysaccharide.

Typically, the polysaccharides of the present invention have a molecular weight in the range of from 10 000 to 10 000 000, for example from 20 000 to 1 000 000, typically from 50 000 to 500 000, or even from 60 000 to 150 000 g/mol.

Degree of Polymerisation (DP) of the Substituted Polysaccharide.

The substituted polysaccharide may have a total number of sugar units from 10 to 7000, or of at least 20. Suitable substituted polysaccharides that are useful in the present invention include polysaccharides with a degree of polymerization (DP) over 40, preferably from about 50 to about 100,000, more preferably from about 500 to about 50,000.

The total number of sugar units of the substituted polysaccharide is for example from 10 to 10 000, or 20 to 7500, for example 50 to 5000 and typically 100 to 3000, or from 150 to 2000.

Synthesis

The substituted polysaccharide used in the present invention may be synthesised by a variety of routes which are well known to those skilled in the art of polymer chemistry. For instance, carboxyalkyl ether-linked polysaccharides can be made by reacting a polysaccharide with a suitable haloalkanoic acid, carboxyalkyl ester-linked polysaccharides can be made by reacting a polysaccharide with a suitable anhydride, such as succinic anhydride, and sulfoalkyl ether-linked polysaccharides can be made by reacting a polysaccharide with a suitable alkenyl sulfonic acid.

The skilled person may obtain substituted polysaccharide with a higher degree of blockiness for example by choosing the solvent of the reaction, the rate of addition of the reactants, and the alkalinity of the medium during the substituted polysaccharide synthesis. The synthetic process can be optimised to control the DB, as discussed in V. Stigsson et al., Polysaccharide, 2006, 13, pp 705-712; N. Olaru et al, Macromolecular Chemistry & Physics, 2001, 202, pp 207-211; J. Koetz et al, Papier (Heidelburg), 1998, 52, pp 704-712; G. Mann et al, Polymer, 1998, 39, pp 3155-3165. Methods for producing carboxymethyl polysaccharide and hydroxyethyl polysaccharide having blocky characteristics are also disclosed in WO 2004/048418 (Hercules) and WO 06/088953 (Hercules).

Preferred Substituted Polysaccharides

The substituted polysaccharide may in particular be chosen from carboxymethyl cellulose, methylcarboxymethylcellulose, sulfoethylcellulose, methylhydroxyethylcellulose, carboxymethyl xyloglucan, carboxymethyl xylan, sulfoethylgalactomannan, carboxymethyl galactomannan, hydoxyethyl galactomannan, sulfoethyl starche, carboxymethyl starch, and mixture thereof.

Laundry Adjunct Ingredient

The laundry treatment composition further comprises a laundry adjunct ingredient. This laundry adjunct ingredient is different to the ingredients) required to obtain the substituted polysaccharide. For example, the laundry adjunct ingredient is not the solvent used to obtain the substituted polysaccharide by reacting the polysaccharide backbone and the substituent. The precise nature of these additional adjunct components, and levels of incorporation thereof, will depend on the physical form of the composition and the nature of the operation for which it is to be used. Suitable adjunct materials include, but are not limited to, surfactants, builders, flocculating aid, chelating agents, dye transfer inhibitors, enzymes, enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, and/or pigments. In addition to the disclosure below, suitable examples of such other adjuncts and levels of use are found in U.S. Pat. Nos. 5,576,282, 6,306,812 B1 and 6,326,348 B1 that are incorporated by reference. Such one or more adjuncts may be present as detailed below:

ENZYME—Preferably, the composition of the invention further comprises an enzyme. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. The compositions of the present invention may in particular comprise an enzyme having endo-β-1,4-glucanase activity (E.C.3.4.1.4). Non-limiting examples of suitable endo-β-1,4-glucanase enzymes include Celluclean (Novozymes), Carezyme (Novozymes), Celluzyme (Novozymes), Endolase (Novozymes), KAC (Kao), Puradax HA (Genencor), Puradax EG-L (Genencor), the 20 kDa endo-β-1,4-glucanase endogenous to Melanocarpus Albomyces sold under the Biotouch brand (AB Enzymes), and variants and mixtures of these. Suitable enzymes are listed in WO2007/025549A1, page 4 line 15 to page 11 line 2.

When present in the detergent composition, the aforementioned enzymes may be present at levels from about 0.00001% to about 2%, from about 0.0001% to about 1% or even from about 0.001% to about 0.5% or 0.02% enzyme protein by weight of the composition.

SURFACTANT—The compositions according to the present invention may comprise a surfactant or surfactant system. The compositions may comprise from 0.01% to 90%, for example from 1 to 25, or from 2 to 20, or from 4 to 15, or from 5 to 10%, by weight of a surfactant system. The surfactant may be selected from nonionic surfactants, anionic surfactants, cationic surfactants, ampholytic surfactants, zwitterionic surfactants, semi-polar nonionic surfactants and mixtures thereof.

Anionic Surfactants

Typically, the composition comprises from 1 to 50 wt % or from 2 to 40 wt % anionic surfactant.

Suitable anionic surfactants typically comprise one or more moieties selected from the group consisting of carbonate, phosphate, phosphonate, sulfate, sulfonate, carboxylate and mixtures thereof. The anionic surfactant may be one or mixtures of more than one of $C_{8-18}$ alkyl sulfates and $C_{8-18}$ alkyl sulfonates, linear or branched, optionally condensed with from 1 to 9 moles of $C_{1-4}$ alkylene oxide per mole of $C_{8-18}$ alkyl sulfate and/or $C_{8-18}$ alkyl sulfonate.

Preferred anionic detersive surfactants are selected from the group consisting of: linear or branched, substituted or unsubstituted, $C_{12-18}$ alkyl sulfates; linear or branched, substituted or unsubstituted, $C_{10-13}$ alkylbenzene sulfonates, preferably linear $C_{10-13}$ alkylbenzene sulfonates; and mixtures thereof. Highly preferred are linear $C_{10-13}$ alkylbenzene sulfonates. Highly preferred are linear $C_{10-13}$ alkylbenzene sulfonates that are obtainable, preferably obtained, by sulfonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

Alkoxylated Anionic Surfactants

The composition may comprise an alkoxylated anionic surfactant. When present alkoxylated anionic surfactant will generally be present in amounts form 0.1 wt % to 40 wt %, for example from 1 wt % to 3 wt % based on the detergent composition as a whole.

Typically, the alkoxylated anionic detersive surfactant is a linear or branched, substituted or unsubstituted $C_{12-18}$ alkyl alkoxylated sulfate having an average degree of alkoxylation of from 1 to 30, preferably from 3 to 7.

Suitable alkoxylated anionic detersive surfactants are: Texapan LEST™ by Cognis; Cosmacol AES™ by Sasol; BES151™ by Stephan; Empicol ESC70/U™; and mixtures thereof.

Non-Ionic Detersive Surfactant

The compositions of the invention may comprise non-ionic surfactant. Where present the non-ionic detersive surfactant(s) is generally present in amounts of from 0.5 to 20 wt %, or from 2 wt % to 4 wt %.

The non-ionic detersive surfactant can be selected from the group consisting of: alkyl polyglucoside and/or an alkyl alkoxylated alcohol; $C_{12}$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

Cationic Detersive Surfactant

In one aspect of the invention, the detergent compositions are free of cationic surfactant. However, the composition optionally may comprise a cationic detersive surfactant. When present, preferably the composition comprises from 0.1 wt % to 10 wt %, or from 1 wt % to 2 wt % cationic detersive surfactant.

Suitable cationic detersive surfactants are alkyl pyridinium compounds, alkyl quaternary ammonium compounds, alkyl quaternary phosphonium compounds, and alkyl ternary sulfonium compounds. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium surfactants as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. No. 4,228,042, U.S. Pat. No. 4,239,660, U.S. Pat. No. 4,260,529 and U.S. Pat. No. 6,022,844; amino surfactants as described in more detail in U.S. Pat. No. 6,221,825 and WO 00/47708, specifically amido propyldimethyl amine; and mixtures thereof.

Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride. Cationic surfactants such as Praepagen HY (tradename Clariant) may be useful and may also be useful as a suds booster.

BUILDER—The detergent composition may comprise one or more builders. When a builder is used, the subject composition will typically comprise from 1% to about 40%, typically from 2 to 25%, or even from about 5% to about 20%, or from 8 to 15% by weight of builder.

The detergent compositions of the present invention comprise from 0 to 20%, in particular less than 15% or 10%, for example less than 5% of zeolite. In particular, the detergent composition comprises from 0 to 20%, in particular less than 15% or 10%, for example less than 5% of aluminosilicate builder(s).

The detergent composition of the present invention may comprise from 0 to 20%, in particular less than 15% or 10%, for example less than 5% of phosphate builder and/or silicate builder and/or zeolite builder.

The detergent compositions of the present invention may comprise from 0 to 20%, in particular less than 15% or 10%, for example less than 5% of sodium carbonate.

Builders include, but are not limited to, the alkali metal, ammonium and alkanolammonium salts of polyphosphates, alkali metal silicates, layered silicates, such as SKS-6 of Clariant®, alkaline earth and alkali metal carbonates, aluminosilicate builders, such as zeolite, and polycarboxylate compounds, ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, fatty acids, the various alkali metal, ammonium and substituted ammonium salts of polyacetic acids such as ethylenediamine tetraacetic acid and nitrilotriacetic acid, as well as polycarboxylates such as mellitic acid, succinic acid, citric acid, oxydisuccinic acid, polymaleic acid, benzene 1,3,5-tricarboxylic acid, carboxymethyloxysuccinic acid, and soluble salts thereof.

The total amount of phosphate builder(s), aluminosilicate builder(s), polycarboxylic acid builder(s), and additional silicate builder(s) in the detergent composition may be comprised from 0 to 25%, or even from 1 to 20%, in particular from 1 to 15%, especially from 2 to 10%, for example from 3 to 5%, by weight.

The composition may further comprise any other supplemental builder(s), chelant(s), or, in general, any material which will remove calcium ions from solution by, for example, sequestration, complexation, precipitation or ion exchange. In particular the composition may comprise materials having at a temperature of 25° C. and at a 0.1M ionic strength a calcium binding capacity of at least 50 mg/g and a calcium binding constant log K $Ca^{2+}$ of at least 3.50.

In the composition of the invention, the total amount of phosphate builder(s), aluminosilicate builder(s), polycarboxylic acid builder(s), additional silicate builder(s), and other material(s) having a calcium binding capacity superior to 50 mg/g and a calcium binding constant higher than 3.50 in the composition may be comprised from 0 to 25%, or even from 1 to 20%, in particular from 1 to 15%, especially from 2 to 10%, for example from 3 to 5%, by weight.

FLOCCULATING AID—The composition may further comprise a flocculating aid. The composition may also be substantially free of flocculating aid. Typically, the flocculating aid is polymeric. Typically the flocculating aid is a polymer comprising monomer units selected from the group consisting of ethylene oxide, acrylamide, acrylic acid and mixtures thereof. Typically the flocculating aid is a polyethyleneoxide. Typically the flocculating aid has a molecular weight of at least 100,000 Da, in particular from 150,000 Da to 5,000,000 Da or even from 200,000 Da to 700,000 Da. Typically, the composition comprises at least 0.3% by weight of the composition of a flocculating aid.

BLEACHING AGENT—The compositions of the present invention may comprise one or more bleaching agents. In general, when a bleaching agent is used, the compositions of the present invention may comprise from about 0.1% to about 50% or even from about 0.1% to about 25% bleaching agent by weight of the subject detergent composition. When present, suitable bleaching agents include bleaching catalysts, suitable bleaching catalysts are listed in WO2008/034674A1, page 46 line 23 to page 49 line 17, photobleaches for example Vitamin K3 and zinc or aluminium phtalocyanine sulfonate; bleach activators such as tetraacetyl ethylene diamine (TAED) and nonanoyloxybenzene sulfonate (NOBS); hydrogen peroxide; pre-formed peracids; sources of hydrogen peroxide such as inorganic perhydrate salts, including alkali metal salts such as sodium salts of perborate (usually mono- or tetra-hydrate), percarbonate, persulfate, perphosphate, persilicate salts and mixtures thereof, optionally coated, suitable coatings including inorganic salts such as alkali metal; and mixtures thereof.

The amounts of hydrogen peroxide source and peracid or bleach activator may be selected such that the molar ratio of available oxygen (from the peroxide source) to peracid is from 1:1 to 35:1, or even 2:1 to 10:1

FLUORESCENT WHITENING AGENT—The composition may contain components that may tint articles being cleaned, such as fluorescent whitening agent. When present, any fluorescent whitening agent suitable for use in a detergent composition may be used in the composition of the present invention. The most commonly used fluorescent whitening agents are those belonging to the classes of diaminostilbenesulfonic acid derivatives, diarylpyrazoline derivatives and bisphenyl-distyryl derivatives.

Typical fluorescent whitening agents are Parawhite KX, supplied by Paramount Minerals and Chemicals, Mumbai, India; Tinopal® DMS and Tinopal® CBS available from Ciba-Geigy AG, Basel, Switzerland. Tinopal® DMS is the disodium salt of 4,4'-bis-(2-morpholino-4-anilino-s-triazin-6-ylamino) stilbene disulfonate. Tinopal® CBS is the disodium salt of 2,2'-bis-(phenyl-styryl)disulfonate.

FABRIC HUEING AGENTS—Fluorescent whitening agents emit at least some visible light. In contrast, fabric hueing agents alter the tint of a surface as they absorb at least a portion of the visible light spectrum. Suitable fabric hueing agents include dyes and dye-clay conjugates, and may also include pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof. Suitable hueing dyes are listed in WO2008/17570A1, page 4 line 15 to page 11 line 18 and WO2008/07318A2, page 9, line 18 to page 21 line 2.

POLYMERIC DISPERSING AGENTS—the compositions of the present invention can contain additional polymeric dispersing agents. Suitable polymeric dispersing agents, include polymeric polycarboxylates, substituted (including quarternized and oxidized) polyamine polymers, and polyethylene glycols, such as: acrylic acid-based polymers having an average molecular of about 2,000 to about 10,000; acrylic/maleic-based copolymers having an average molecular weight of about 2,000 to about 100,000 and a ratio of acrylate to maleate segments of from about 30:1 to about 1:1; maleic/acrylic/vinyl alcohol terpolymers; polyethylene glycol (PEG) having a molecular weight of about 500 to about 100,000, preferably from about 1,000 to about 50,000, more preferably from about 1,500 to about 10,000; and water soluble or dispersible alkoxylated polyalkyleneamine materials. These polymeric dispersing agents, if included, are typically at levels up to about 5%, preferably from about 0.2% to about 2.5%, more preferably from about 0.5% to about 1.5%.

POLYMERIC SOIL RELEASE AGENT—The compositions of the present invention can also contain polymeric soil release agent. polymeric soil release agent, or "SRA", have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures. Preferred SRA's include oligomeric terephthalate esters; sulfonated product of a substantially linear ester oligomer comprised of an oligomeric ester backbone of terephthaloyl and oxyalkyleneoxy repeat units and allyl-derived sulfonated terminal moieties covalently attached to the backbone; nonionic end-capped 1,2-propylene/polyoxyethylene terephthalate polyesters; an oligomer having empirical formula $(CAP)_2$ $(EG/PG)_5$ $(T)_5$ $(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two-end-cap units derived from sodium 2-(2-hydroxyethoxy)-ethanesulfonate; oligomeric esters comprising: (1) a backbone comprising (a) at least one unit selected from the group consisting of dihydroxy sulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$((CAP)_a(EG/PG)_b(DEG)_cPEG)_d(T)_e(SIP)_f(SEG)_g(B)_h)$$

wherein CAP, EG/PG, PEG, T and SIP are as defined hereinabove, DEG represents di(oxyethylene)oxy units, SEG represents units derived from the sulfoethyl ether of glycerin and related moiety units, B represents branching units which are at least trifunctional whereby ester linkages are formed resulting in a branched oligomer backbone, a is from about 1 to about 12, b is from about 0.5 to about 25, c is from 0 to about 12, d is from 0 to about 10, b+c+d totals from about 0.5 to about 25, e is from about 1.5 to about 25, f is from 0 to about 12; e+f totals from about 1.5 to about 25, g is from about 0.05 to about 12; h is from about 0.01 to about 10, and a, b, c, d, e, f, g, and h represent the average number of moles of the corresponding units per mole of the ester; and the ester has a molecular weight ranging from about 500 to about 5,000; and; cellulosic derivatives such as the hydroxyether cellulosic polymers available as METHOCEL® from Dow; the $C_1$-$C_4$ alkyl polysaccharides and $C_4$ hydroxyalkyl polysaccharides, see U.S. Pat. No. 4,000,093, issued Dec. 28, 1976 to Nicol et al., and the methyl polysaccharide ethers having an average degree of substitution (methyl) per anhydrosugar unit from about 1.6 to about 2.3 and a solution viscosity of from about 80 to about 120 centipoise measured at 20° C. as a 2% aqueous solution. Such materials are available as METOLOSE SM100® and METOLOSE SM200®, which are the trade names of methyl polysaccharide ethers manufactured by Shinetsu Kagaku Kogyo KK.

ENZYME STABILIZERS—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability.

CATALYTIC METAL COMPLEXES—The compositions of the invention may comprise catalytic metal complexes. When present, one type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. Pat. No. 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

SOFTENING SYSTEM—the compositions of the invention may comprise a softening agent and optionally also with flocculants and enzymes; optionally for softening through the wash.

FABRIC SOFTENING BOOSTING COMPONENT—Typically, the composition additionally comprises a charged polymeric fabric-softening boosting component. When the composition comprises clay and silicone particles, preferably, the charged polymeric fabric-softening boosting component is contacted to the clay and silicone in step (ii) of the process for obtaining clay and silicone particles (see above). The intimate mixing of the charged polymeric fabric-softening boosting component with the clay and silicone further improves the fabric-softening performance of the resultant composition.

COLORANT—the compositions of the invention may comprise a colorant, preferably a dye or a pigment. Particularly, preferred dyes are those which are destroyed by oxidation during a laundry wash cycle. To ensure that the dye does not decompose during storage it is preferable for the dye to be stable at temperatures up to 40° C. The stability of the dye in the composition can be increased by ensuring that the water content of the composition is as low as possible. If possible, the dyes or pigments should not bind to or react with textile fibres. If the colorant does react with textile fibres, the colour imparted to the textiles should be destroyed by reaction with the oxidants present in laundry wash liquor. This is to avoid coloration of the textiles, especially over several washes. Particularly, preferred dyes include but are not limited to Basacid® Green 970 from BASF and Monastral blue from Albion.

Laundry Treatment Composition

The laundry treatment composition is preferably a laundry detergent composition or a fabric care composition.

The laundry treatment composition may comprise a solvent. Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

The laundry treatment composition is for example in particulate form, preferably in free-flowing particulate form, although the composition may be in any liquid or solid form. The composition in solid form can be in the form of an agglomerate, granule, flake, extrudate, bar, tablet or any combination thereof. The solid composition can be made by methods such as dry-mixing, agglomerating, compaction, spray drying, pan-granulation, spheronization or any combination thereof. The solid composition preferably has a bulk density of from 300 g/l to 1,500 g/l, preferably from 500 g/l to 1,000 g/l.

The substituted cellulose may be added as a dry added component or via laundry particles formed by spray drying or extrusion.

The laundry treatment composition may also be in the form of a liquid, gel, paste, dispersion, preferably a colloidal dispersion or any combination thereof. Liquid compositions typically have a viscosity of from 500 mPa·s to 3,000 mPa·s, when measured at a shear rate of 20 $s^{-1}$ at ambient conditions (20° C. and 1 atmosphere), and typically have a density of from 800 g/l to 1300 g/l. If the composition is in the form of a dispersion, then it will typically have a volume average particle size of from 1 micrometer to 5,000 micrometers, preferably from 1 micrometer to 50 micrometers. The particles that form the dispersion are usually the clay and, if present, the silicone. Typically, a Coulter Multisizer is used to measure the volume average particle size of a dispersion.

The laundry treatment composition may be in unit dose form, including not only tablets, but also unit dose pouches wherein the composition is at least partially enclosed, preferably completely enclosed, by a film such as a polyvinyl alcohol film.

The laundry treatment composition may also be in the form of an insoluble substrate, for example a non-woven sheet, impregnated with detergent actives.

The laundry treatment composition may be capable of cleaning and/or softening fabric during a laundering process. Typically, the laundry treatment composition is formulated for use in an automatic washing machine, although it can also be formulated for hand-washing use.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

The following examples are given by way of illustration only and therefore should not be construed to limit the scope of the invention.

EXAMPLES

Example 1

Preparation of Compositions A, B, 1 and 2

The following abbreviation have been used:

LAS: Sodium linear alkylbenzene sulfonate

STPP: Sodium tripolyphosphate

Other detergent ingredients include materials such as protease, optical brightener, water and perfume.

Celulase enzyme: Celluclean®, supplied by Novozymes, Bagsvaerd, Denmark. Enzyme level expressed as active protein concentration in the wash liquor.

LB CMC: carboxymethyl cellulose, Finnfix® BDA supplied by CPKelco, Arnhem, Netherlands.

HB CMC: carboxymethyl cellulose, Highly blocky CMC supplied by CPKelco, Arnhem, Netherlands.

The viscosity, degree of substitution and degree of blockiness of these two CMC are given in the table below:

| | Viscosity as 2% solution (mPa · s) | Degree of substitution (DS) | Degree of blockiness (DB) |
|---|---|---|---|
| LB CMC | 77 | 0.53 | 0.33 |
| HB CMC | 1740 | 0.76 | 0.50 |

A base composition was prepared:

| Ingredient | Weight % |
|---|---|
| LAS | 16.00 |
| STPP | 12.00 |
| Sodium carbonate | 20.00 |
| Sodium silicate (2.0R) | 6.00 |
| Sodium sulfate | 45.64 |
| Other detergent ingredients | 0.36 |

The following formulations were prepared:

| Example | |
|---|---|
| Comparative composition A | Base composition |
| Comparative composition B | Base composition + 1.0 wt % LB CMC |
| Composition 1 | Base composition + 0.3 wt % HB CMC |
| Composition 2 | Base composition + 0.3 wt % HB CMC + 0.05 ppm cellulase enzyme |

Example 2

Antiredeposition Performance of Compositions A, B, 1 and 2

This method was used to compare the relative performance of a lower blockiness CMC (LB CMC) with a highly blocky CMC (HB CMC) in accordance with the invention.

In the following test, test wash solutions were prepared, using water of 12 gpg hardness, containing 2 g/l (based on the weight of the base composition) of the composition A, B, C, 1 or 2. The test fabrics were 5 cm×5 cm squares of white knitted cotton, supplied by Warwick Equest, Stanley, County Durham, UK. Eight replicates used for each test formulation. The same fabric type was used to make up the ballast load. Tergotometer pots were 1 l pot size, supplied by Copley Scientific, Nottingham, UK. Ballast were knitted cotton added to maintain 30:1 water:cloth ratio. Soil was 100 ppm carbon black, supplied by Warwick Equest, Stanley, County Durham, UK.

Tergotometer pots containing a test wash solution (0.8 L) plus test fabrics, ballast and soil at 25° C. were agitated at 200 rpm for 20 minutes. After the wash, the test fabrics and ballast were separated. The process was repeated using washed test fabrics for 4 cycles. Clean ballast is used for each wash cycle. The test fabrics were then rinsed in water (12 gpg hardness) in the tergotometer pots with 200 rpm agitation for 5 minutes, followed by drying at ambient room temperature for at least 12 hours.

The reflectance values of the test fabrics were measured (460 nm, D65/10°) before washing and after 4 cycles. The following table shows mean reflectance values after the 4 cycles, expressed as change compared to untreated fabrics as well as the benefice in the reflectance change when compared with the base composition.

| Example | Number of replicates | Mean Reflectance (460 nm) change after 4 cycles | Benefice in the Reflectance change |
|---|---|---|---|
| Comparative composition A | 8 | −40.15 | Ref |
| Comparative composition B | 8 | −35.57 | +4.58 |
| Composition 1 | 8 | −33.12 | +7.03 |
| Composition 2 | 8 | −28.84 | +11.31 |

This method quantifies the anti-deposition properties of the test formulations. Reflectance values decreases with deposition of carbon black soil: the smaller the drop in reflectance, the better the anti-deposition properties of the detergent formulation.

The results show that in the absence of cellulase enzyme, HB-CMC, a substituted polysaccharide according to the invention achieves significantly improved anti-redeposition performance compared to a much higher level of LB CMC (Composition 1 vs Comparative composition B). It can also be seen that the presence of cellulase leads to an enhancement in the anti-redeposition performance of HB-CMC (composition 2 vs composition 1).

Examples 3-8

The following are granular detergent compositions produced in accordance with the invention suitable for laundering fabrics by handwashing or top-loading washing machines.

| | 3 (wt %) | 4 (wt %) | 5 (wt %) | 6 (wt %) | 7 (wt %) | 8 (wt %) |
|---|---|---|---|---|---|---|
| Linear alkylbenzenesulfonate | 20 | 12 | 20 | 10 | 12 | 13 |
| Other surfactants | 1.6 | 1.2 | 1.9 | 3.2 | 0.5 | 1.2 |
| Phosphate builder(s) | 5 | 25 | 4 | 3 | 2 | |
| Zeolite | | 1 | | 1 | 4 | 1 |
| Silicate | 4 | 5 | 2 | 3 | 3 | 5 |
| Sodium Carbonate | 9 | 20 | 10 | 17 | 5 | 23 |
| Polyacrylate (MW 4500) | 1 | 0.6 | 1 | 1 | 1.5 | 1 |
| Substituted polysaccharide[1] | 1 | 0.3 | 0.3 | 0.1 | 1.1 | 0.9 |
| Cellulase[2] | 0.1 | | 0.1 | | 0.3 | 0.1 |
| Other enzymes powders | 0.23 | 0.17 | 0.5 | 0.2 | 0.2 | 0.6 |
| Fluorescent Brightener(s) | 0.16 | 0.06 | 0.16 | 0.18 | 0.16 | 0.16 |
| Diethylenetriamine pentaacetic acid or Ethylene diamine tetraacetic acid | 0.6 | | 0.6 | 0.25 | 0.6 | 0.6 |
| $MgSO_4$ | 1 | 1 | 1 | 0.5 | 1 | 1 |
| Bleach(es) and Bleach activator(s) | 6.88 | | 6.12 | 2.09 | 1.17 | 4.66 |
| Sulfate/Moisture/perfume | Balance to 100% | Balance to 100% | Balance to 100% | Balance to 100% | Balance to 100% | Balance to 100% |

Examples 9-14

The following are granular detergent compositions produced in accordance with the invention suitable for laundering fabrics by front-loading washing machine.

| | 9 (wt %) | 10 (wt %) | 11 (wt %) | 12 (wt %) | 13 (wt %) | 14 (wt %) |
|---|---|---|---|---|---|---|
| Linear alkylbenzenesulfonate | 8 | 7.1 | 7 | 6.5 | 7.5 | 7.5 |
| Other surfactants | 2.95 | 5.74 | 4.18 | 6.18 | 4 | 4 |
| Layered silicate | 2.0 | | 2.0 | | | |
| Zeolite | 7 | | 7 | | 2 | 2 |
| Citric Acid | 3 | 5 | 3 | 4 | 2.5 | 3 |
| Sodium Carbonate | 15 | 20 | 14 | 20 | 23 | 23 |
| Silicate | 0.08 | | 0.11 | | | |
| Soil release agent | 0.75 | 0.72 | 0.71 | 0.72 | | |
| Acrylic Acid/Maleic Acid Copolymer | 1.1 | 3.7 | 1.0 | 3.7 | 2.6 | 3.8 |
| Substituted polysaccharide[1] | 0.15 | 1.4 | 0.2 | 1.4 | 1 | 0.5 |
| Cellulase[2] | 0.2 | 0.15 | 0.2 | 0.3 | 0.15 | 0.15 |
| Other enzyme powders | 0.65 | 0.75 | 0.7 | 0.27 | 0.47 | 0.48 |
| Bleach(es) and bleach activator(s) | 16.6 | 17.2 | 16.6 | 17.2 | 18.2 | 15.4 |
| Sulfate/Water & Miscellaneous | Balance to 100% | Balance to 100% | Balance to 100% | Balance to 100% | Balance to 100% | Balance to 100% |

In the exemplified compositions 3-14, the concentrations of the components are in weight percentage and the abbreviated component identifications have the following meanings. LAS: Linear alkylbenzenesulfonate having an average aliphatic carbon chain length $C_{11}$-$C_{12}$, Substituted polysaccharide[1]: any polysaccharide having the DB and DS according to the invention. In particular, carboxymethyl polysaccharide having viscosity (as 2% solution) of 1740 mPa·s, degree of substitution 0.76 and degree of blockiness 0.50, supplied by the Noviant division of CPKelco, Arnhem, Netherlands. Cellulase[2]: Celluclean® (15.6 mg active/g) supplied by Novozymes, Bagsvaerd, Denmark

What is claimed is:

1. A composition being a laundry treatment composition or component thereof, comprising:

a substituted polysaccharide selected from the group consisting of galactomannan, glucomannan, a homoxylan, an (arabino)glucuroxylan, a (glucurono)arabinoxylan, and an arabinoxylan, the substituted polysaccharide having a degree of substitution, DS, of from 0.55 to 0.99 and a degree of blockiness, DB, such that either DS+DB is at least 1.00 or DB+2DS−DS$^2$ is at least 1.20 and a laundry adjunct ingredient.

2. The composition according to claim 1, wherein the substituted polysaccharide has a degree of blockiness, DB, of at least 0.35.

3. The laundry composition according to claim 1, wherein the substituted polysaccharide has a DS+DB, of from 1.05 to 2.00.

4. The composition according to claim 1, wherein the substituted polysaccharide is galactomannan or glucomannan.

5. The composition according to claim 1, wherein the substituted polysaccharide is selected from the group consisting of a homoxylan, an (arabino)glucuroxylan, a (glucurono) arabinoxylan, and an arabinoxylan.

6. The composition according to claim 2, wherein the substituted polysaccharide comprises at least one sugar unit of its backbone which is substituted with a substituent selected from the group consisting of branched, linear or cyclic, substituted or not substituted, saturated or unsaturated alkyl, amine (primary, secondary, tertiary), ammonium salt, amide, urethane, alcohol, carboxylic acid, tosylate, sulfonate, sulfate, nitrate, phosphate, silicone and mixtures thereof.

7. The composition according to claim 1, further comprising an enzyme having endo-β-1,4-glucanase activity.

8. The composition according to claim 1, comprising at least 1% by weight, based on the weight of the composition, of substituted polysaccharide.

9. The composition according to claim 1, further comprising less than 15% by weight, based on the weight of the composition, of one or more builders selected from the group consisting of phosphate builders, silicate builders, and zeolite builders.

10. The composition according to claim 9, comprising less than 10% by weight, based on the weight of the composition, of the one or more builders.

11. The composition according to claim 9, comprising less than 5% by weight, based on the weight of the composition, of the one or more builders.

12. A composition being a laundry treatment composition or component thereof, comprising:

a substituted polysaccharide selected from the group consisting of galactomannan, glucomannan, a homoxylan, an (arabino)glucuroxylan, a (glucurono)arabinoxylan, an arabinoxylan, and a xyloglucan, the substituted polysaccharide having a degree of substitution, DS, of from 0.55 to 0.99 and a degree of blockiness, DB, of at least 0.35, such that either DS+DB is at least 1.00 or DB+2DS−DS$^2$ is at least 1.20 and a laundry adjunct ingredient.

13. The laundry composition according to claim 12, wherein the substituted polysaccharide has a DS+DB, of from 1.05 to 2.00.

14. The composition according to claim 12, wherein the substituted polysaccharide is a xyloglucan.

15. The composition according to claim 12, wherein the substituted polysaccharide is galactomannan or glucomannan.

16. The composition according to claim 12, wherein the substituted polysaccharide is selected from the group consisting of a homoxylan, an (arabino)glucuroxylan, a (glucurono) arabinoxylan, and an arabinoxylan.

17. The composition according to claim 12, wherein the substituted polysaccharide comprises at least one sugar unit of its backbone which is substituted with a substituent selected from the group consisting of branched, linear or cyclic, substituted or not substituted, saturated or unsaturated alkyl, amine (primary, secondary, tertiary), ammonium salt, amide, urethane, alcohol, carboxylic acid, tosylate, sulfonate, sulfate, nitrate, phosphate, silicone and mixtures thereof.

18. The composition according to claim 12, further comprising an enzyme having endo-β-1,4-glucanase activity.

19. The composition according to claim 12, comprising at least 1% by weight, based on the weight of the composition, of substituted polysaccharide.

20. The composition according to claim 12, comprising less than 15% by weight, based on the weight of the composition, of at least one builder selected from the group consisting of phosphate builders, silicate builders, and zeolite builders.

* * * * *